US006901915B2

(12) United States Patent
Winter et al.

(10) Patent No.: US 6,901,915 B2
(45) Date of Patent: Jun. 7, 2005

(54) FUEL INJECTION DEVICE FOR AN INTERNAL COMBUSTION ENGINE

(75) Inventors: Joachim Winter, Korntal-Muenchingen (DE); Detlev Potz, deceased, late of Stuttgart (DE); by Maike Sander-Potz, legal representative, Stuttgart (DE); Gerhard Mack, Stuttgart (DE); Christoph Buehler, Gerlingen (DE); Friedrich Moser, Ludwigsburg (DE); Thomas Kuegler, Korntal-Muenchingen (DE); Philippe Allio, Montluel (FR); Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/415,087

(22) PCT Filed: Aug. 23, 2002

(86) PCT No.: PCT/DE02/03140

§ 371 (c)(1),
(2), (4) Date: Apr. 26, 2004

(87) PCT Pub. No.: WO03/018991

PCT Pub. Date: Mar. 6, 2003

(65) Prior Publication Data

US 2004/0232256 A1 Nov. 25, 2004

(30) Foreign Application Priority Data

Aug. 25, 2001 (DE) ..... 101 41 679

(51) Int. Cl.[7] ..... F02M 41/00
(52) U.S. Cl. ..... 123/467; 239/533.3
(58) Field of Search ..... 123/299, 305, 123/467; 239/533.2, 533.3, 533.12

(56) References Cited

U.S. PATENT DOCUMENTS

| | | | | |
|---|---|---|---|---|
| 4,306,528 A | | 12/1981 | Straubel | |
| 4,538,576 A | | 9/1985 | Schneider | |
| 6,378,503 B1 | * | 4/2002 | Lambert | 123/468 |
| 6,725,838 B2 | * | 4/2004 | Shafer et al. | 123/446 |
| 6,769,635 B2 | * | 8/2004 | Stewart et al. | 239/558 |

FOREIGN PATENT DOCUMENTS

| | | |
|---|---|---|
| DE | 41 23 721 | 6/1992 |
| DE | 100 38 054 | 2/2001 |
| DE | 100 40 738 | 3/2001 |
| EP | 0 972 932 | 1/2000 |

* cited by examiner

*Primary Examiner*—Mahmoud Gimie
(74) *Attorney, Agent, or Firm*—Ronald E. Greigg

(57) ABSTRACT

The fuel injection system has one high-pressure fuel pump and one fuel injection valve for each cylinder of the engine. The fuel injection valve has a first hollow injection valve member and a second valve member guided displaceably, inside the first valve member for controlling first and second opening(s), respectively into the associated engine cylinder. The second valve member is movable by the pressure prevailing in a pressure chamber in an opening direction counter to a closing force and is acted upon at least indirectly by the pressure prevailing in a fuel-filled control chamber, which pressure is controllable as a function of operating parameters of the engine such that the second injection valve member, by means of the pressure prevailing in the control chamber, can be blocked, independently of an opening motion of the first injection valve member in a position that closes the at least one second injection opening.

21 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 02/03140 filed on Aug. 23, 2002.

BACKGROUND OF THE INVENTION

1. Field of the Invention

The invention is directed to an improved fuel injection system for an internal combustion engine of the type having a high pressure pump and a fuel injector for each cylinder of the engine.

2. Description of the Prior Art

One fuel injection system of the type with which this invention is concerned is known from European Patent Disclosure EP 0 957 261 A1. For each cylinder of the engine, this known fuel injection system has one high-pressure fuel pump and one fuel Injection valve communicating with it. The high-pressure fuel pump has a pump piston, which is driven in a reciprocating motion by the engine and which defines a pump work chamber that communicates with a pressure chamber of the fuel injection valve. The fuel Injection valve has an Injection valve member, by which at least one injection opening is controlled, and which is movable by the pressure prevailing in the pressure chamber in an opening direction counter to a closing force. By means of an electrically controlled control valve, a communication of the pump work chamber with a relief chamber is controlled in order to control the fuel injection. When the pressure in the pump work chamber and thus in the pressure chamber of the fuel injection valve reaches the opening pressure, the injection valve member moves In the opening direction and uncovers the at least one injection opening. The injection cross section that is controlled by the injection valve member in the process is always the same size. This does not enable optimal fuel injection under all engine operating conditions.

SUMMARY OF THE INVENTION

The fuel injection system of the invention has the advantage over the prior art that by means of the second injection valve member, an additional injection cross section can be opened or closed with the at least one injection opening as a function of engine operating parameters, so that the injection cross section can be adapted optimally to engine operating conditions.

Various advantageous features and refinements of the fuel injection system of the invention are disclosed. One embodiment makes simple control of the control pressure in the control chamber possible. In another this control can be attained without requiring any additional component. A further embodiment makes it possible upon the supply onset of the pump piston initially to uncover only a slight injection cross section with the at least one injection opening, and upon a greater stroke of the pump piston additionally to uncover a larger injection cross section with the at least one second injection opening. The stroke length of the pump piston beyond which the at least one second injection opening is opened may be varied.

BRIEF DESCRIPTION OF THE DRAWINGS

The foregoing and other features of the invention will become apparent from the description contained herein below, taken in conjunction with the drawings, in which.

DESCRIPTION OF THE PREFERRED EMBODIMENTS

Figure 1:
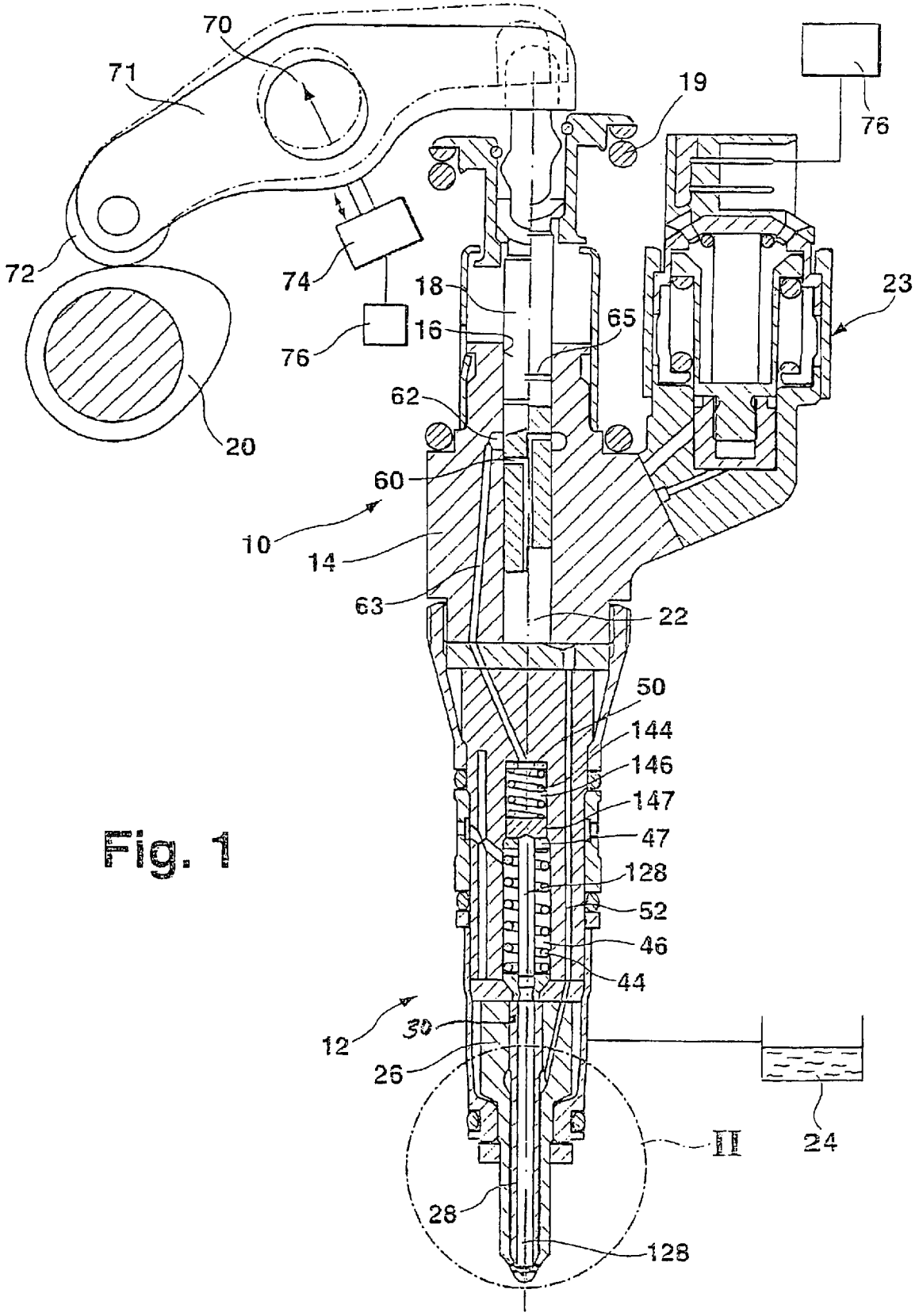
FIG. 1 shows a fuel injection system for an internal combustion engine schematically in a first exemplary embodiment.
Figure 2:
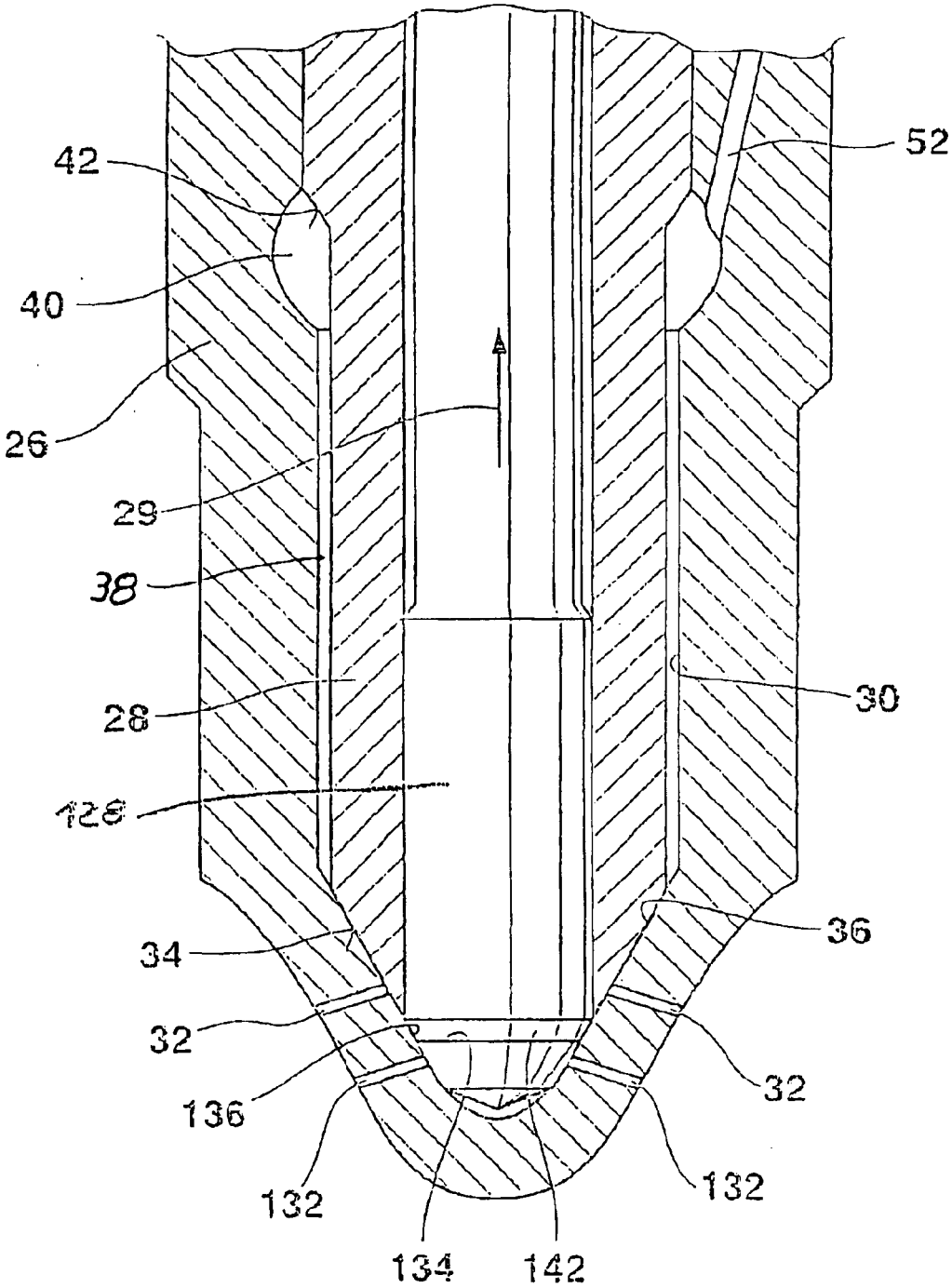
FIG. 2 is an enlarged view of a detail of a fuel injection valve, marked II in FIG. 1.
Figure 3:
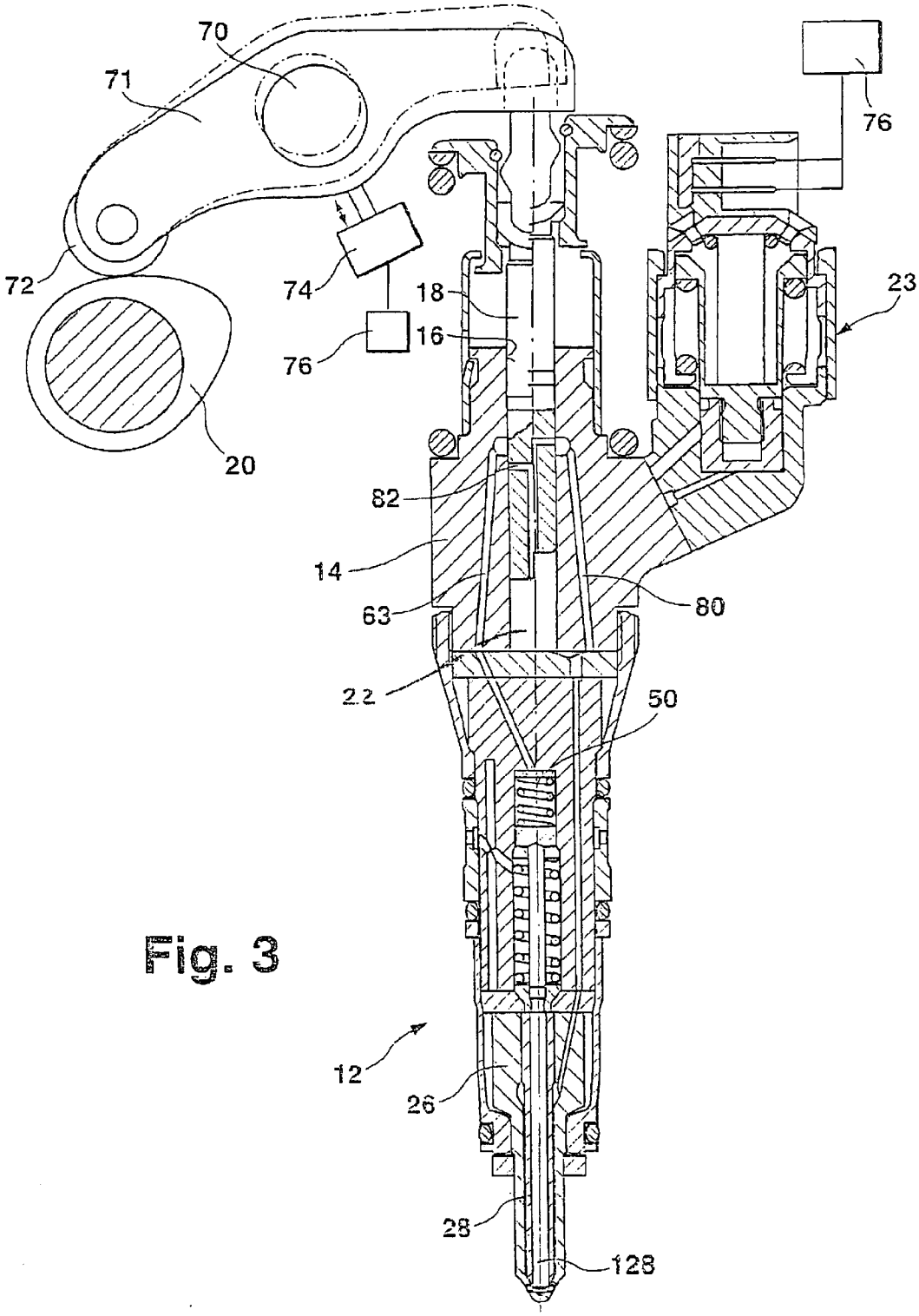
FIG. 3 shows the fuel injection system in a second exemplary embodiment.

In FIGS. 1–3, a fuel injection system for an internal combustion engine of a motor vehicle is shown. The engine is preferably a self-igniting internal combustion engine. The fuel injection system is embodied as a so-called unit injector or pump-line-nozzle system and for each cylinder of the engine has one high-pressure fuel pump 10 and one fuel injection valve 12 communicating with it. In an embodiment as a pump-line-nozzle system, the high-pressure fuel pump 10 is disposed at a distance from the fuel injection valve 12 and communicates with it via a line. In the exemplary embodiments shown, the fuel injection system is embodied as a unit injector, in which the high-pressure fuel pump 10 and the fuel injection valve 12 communicate directly with one another and form a structural unit. The high-pressure fuel pump 10 has a pump piston 18, guided tightly in a cylinder bore 16 in a pump body 14, and this piston is driven in a reciprocating motion by a cam 20 of a camshaft of the engine, counter to the force of a restoring spring 19. In the cylinder 16, the pump piston 18 defines a pump work chamber 22, in which in the pumping stroke of the pump piston 18 fuel is compressed at high pressure. In the intake stroke of the pump piston 18, fuel from a fuel tank 24 of the motor vehicle is delivered to the pump work chamber 22 in a manner not shown in further detail.

The fuel injection valve 12 has a valve body 26, which can be embodied in multiple parts and in which a first injection valve member 28 is guided longitudinally displaceably in a bore 30. In its end region toward the combustion chamber of the cylinder of the engine, the valve body 26 has at least one first injection opening, and preferably a plurality of first injection openings 32, which are distributed over the circumference of the valve body 26. The first injection valve member 28, in its end region toward the combustion chamber, has a sealing face 34, which for instance is approximately conical, and which cooperates with a valve seat 36 embodied in the end region of the valve body 26 oriented toward the combustion chamber, and from this valve seat or downstream of it, the first injection openings 32 lead away. Between the injection valve member 28 and the bore 30 in the valve body 26, toward the valve seat 36, there is an annular chamber 38, which in its end region remote from the valve seat 36 changes over, by means of a radial widening of the bore 30, into a pressure chamber 40 that surrounds the first injection valve member 28. At the level of the pressure chamber 40, as a result of a cross-sectional reduction, the first injection valve member 28 has a pressure shoulder 42. The end of the first injection valve member 28 remote from the combustion chamber is engaged by a first prestressed closing spring 44, by which the first injection valve member 28 is pressed toward the valve seat 36. The first closing spring 44 is disposed in a first spring chamber 46 of the valve body 26, which chamber adjoins the bore 30.

The first injection valve member 28 of the fuel injection valve 12 is embodied as hollow, and in it, a second injection valve member 128 is guided displaceably in a bore embodied coaxially in the injection valve member 28. By means of the second injection valve member 128, at least one second injection opening 132 in the valve body 26 is controlled. The at least one second injection opening 132 is offset toward the combustion chamber in the direction of the longitudinal axis of the injection valve members 28, 128 from the at least one first injection opening 32. The second injection valve member 128, in its end region toward the combustion chamber, has a sealing face 134, which for instance is approximately conical, and which cooperates with a valve seat 136, embodied in the valve body 26 in its end region toward the combustion chamber, from which or downstream of which valve seat the second injection openings 132 lead away. The second injection valve member 128 can be embodied in two parts and can have one part, toward the combustion chamber, that has the sealing face 134 and one second part, pointing away from the combustion chamber, that adjoins the first part. Near the end toward the combustion chamber of the second injection valve member 128, a pressure face 142 is embodied on the injection valve member, and when the first injection valve member 28 is opened, the pressure prevailing in the pressure chamber 40 acts on this pressure face.

A second spring chamber 146 is embodied in the valve body 26, adjacent to the first spring chamber 46 in the direction away from the combustion chamber, and in this second spring chamber, a second closing spring 144, acting on the second injection valve member 128, is disposed. The first injection valve member 28 protrudes with its end into the first spring chamber 46 and is braced on the first closing spring 44. The first closing spring 44 is braced with its end remote from the first injection valve member 28 on a sleeve 47, which is disposed between the first spring chamber 46 and the second spring chamber 146 and which for instance is press-fitted into the valve body 26. The second injection valve member 128 protrudes through the sleeve 47 into the second spring chamber 146, and it is braced on the second closing spring 144 via a spring plate 147. The second closing spring 144 is braced, by its end remote from the second valve member 128, on the bottom of the second spring chamber 146. By means of the spring plate 147, a control chamber 50 is defined in the second spring chamber 146.

From the pump work chamber 22, a conduit 52 leads through the pump body 14 and the valve body 26 into the pressure chamber 40 of the fuel injection valve 12. By means of an electrically controlled valve 23, a communication of the pump work chamber 22 with a relief chamber is controlled; by way of example, the fuel tank 24 can serve at least indirectly as this relief chamber, or a region in which a pressure that is somewhat elevated compared to the fuel tank 24 is maintained can serve as the relief chamber. As long as no fuel injection is to occur, the control valve 23 is intended to keep the communication of the pump work chamber 22 with the relief chamber open, so that high pressure cannot build up in the pump work chamber 22. When a fuel injection is to occur, the pump work chamber 22 is disconnected from the relief chamber by the control valve 23, so that upon the pumping stroke of the pump piston 18, high pressure can build up in the pump work chamber 22. The control valve 23 can be embodied as a magnet valve or as a piezoelectric valve.

The fuel injection system is shown in a first exemplary embodiment in FIGS. 1 and 2. In the first exemplary embodiment, the pump piston 18 has a conduit 60, extending in this piston, that discharges at one end into the pump work chamber 22, in a portion on the face end of the pump piston 18 extending in the direction of the longitudinal axis of the pump piston 18, and on the other end discharges into a portion, extending approximately radially to the longitudinal axis of the pump piston 18, at the jacket face of the pump piston 18 at some distance from the face end. The radial portion of the conduit 60 can for instance be embodied diametrically continuously by the pump piston 18. In the pump body 14, in the cylinder bore 16, an encompassing annular groove 62 is embodied, which communicates with the control chamber 50 via a conduit 63 extending through the pump body 14 and the valve body 26. Thus by means of the pump piston 18, as a function of its stroke, a communication of the control chamber 50 with the pump work chamber 22 is controlled. The pump work chamber 22 serves as a pressure source for controlling the pressure in the control chamber 50. At a slight pumping stroke of the pump piston 18 into the pump work chamber 22, the orifice of the conduit 60 is located on the jacket face of the pump piston 18, coinciding with the annular groove 62, so that the control chamber 50 communicates with the pump work chamber 22. As the pumping stroke of the pump piston 18 lengthens into the pump work chamber 22, the orifice of the conduit 60 is offset from the annular groove 62 on the jacket face of the pump piston 18, so that the control chamber 50 is disconnected from the pump work chamber 22.

Between the camshaft of the engine having the cam 20 and the pump piston 18, an intermediate shaft 70 is disposed, on which a transmission element 71 in the form of a two-armed tilt lever is disposed, which lever rolls with one end over the cam 20, for instance via a roller 72, and is pivotably connected by its other end to the pump piston 18. It is provided that the location of the intermediate shaft 70 having the tilt lever 71 is variable, as a result of which the outset stroke position of the pump piston 18 can be varied. In FIG. 1, the intermediate shaft 70 with the tilt lever 71 and the left half of the pump piston 18 is shown in solid lines in a first position, in which the pump piston 18 has an outset stroke position in which the pump piston 18 plunges relatively far into the cylinder bore 16 in the pump body 14. In FIG. 1, the intermediate shaft 70 with the tilt lever 71 and the right half of the pump piston 18 is shown in dashed lines in a second position, in which the pump piston 18 in its outset stroke position plunges to a lesser extent than in the first position into the cylinder bore 16 in the pump body 14.

An adjustment of the location of the intermediate shaft 70 can be made for instance by means of a hydraulic adjusting device 74, by which the bearing of the intermediate shaft 70 is shifted. Alternatively, the adjusting device 74 can be embodied as an eccentric element, by which the bearing of the intermediate shaft 70 is shifted.

The function of the fuel injection system in the first exemplary embodiment will now be explained. Upon the intake stroke of the pump piston 18, the control valve 23 is opened, so that fuel from the fuel tank 24 reaches the pump work chamber 22. In the pumping stroke of the pump piston 18, the onset of the fuel injection is defined as a result of the fact that the control valve 23 closes, so that the pump work chamber 22 is disconnected from the relief chamber, and high pressure builds up in the pump work chamber 22. As a function of engine operating parameters, the intermediate shaft 70 is adjusted to the requisite position by the adjusting device 74. When the pump piston 18 is in the outset stroke position shown in the right-hand half of FIG. 1, control chamber 50 communicates with the pump work chamber 22, so that a high control pressure prevails in the control chamber 50. If the pressure in the pump work chamber 22 and thus in the pressure chamber 40 of the fuel injection valve 12 is so high that the pressure force generated by it on the first injection valve member 28 via the pressure shoulder 42 is greater than the force of the first closing spring 44, then the fuel injection valve 12 opens, because the first injection valve member 28 lifts with its sealing face 34 from the valve seat 36 and uncovers the at least one first injection opening 32. The control pressure in the control chamber 50 acts via the spring plate 147 on the second injection valve member 128 and reinforces the closing spring 144, so that the pressure force, acting on the second injection valve member 128 via the pressure face 142 as a result of the pressure prevailing in the pressure chamber 40 does not suffice to open the second injection valve member 128. Thus with the first injection openings 32 of the fuel injection valve 12, only a portion of the total injection cross section is opened, and accordingly only a slight fuel quantity is injected.

When the pump piston 18 executes its supply stroke further, the conduit 60 in the pump piston 18 moves away from coincidence with the annular groove 62, and so the control chamber 50 is disconnected from the pump work chamber 22. The control chamber 50 preferably communicates with a relief chamber via at least one throttle restriction, so that the pressure in the control chamber 50 decreases. In this case, now only the force of the second closing spring 144, and possibly a slight pressure force, act on the second injection valve member 128, so that the pressure force acting on the second injection valve member 128 via the pressure face 142 as a result of the pressure prevailing in the pressure chamber 40 does suffice to open the second injection valve member 128 as well, so that the at least one second injection opening 132 is uncovered as well. Thus the entire injection cross section of the fuel injection valve 12 is opened, and a larger fuel quantity is injected. The end of the fuel injection is determined by the opening of the control valve 23, as a result of which the pump work chamber 22 communicates with the relief chamber, and high pressure can no longer build up in it.

The pump piston 18 can have one further conduit 65, which upon a maximal stroke of the pump piston 18 into the pump work chamber 22 comes into coincidence with the annular groove 62 and establishes a communication with a relief chamber. At the maximal stroke of the pump piston 18, the control chamber 50 thus communicates with a relief chamber and is pressure-relieved.

It can be provided that the injection cross sections formed by the first injection openings 32 and the second injection openings 132 are at least of approximately equal size, so that when only the first injection valve member 28 is opened, half of the total injection cross section is uncovered. Alternatively, it can be provided that the first injection openings 32 form a larger or smaller injection cross section than the second injection openings 132.

When the pump piston 18 is in its outset stroke position shown in the left half of FIG. 1, the conduit 60 of the pump piston 18 is not in coincidence with the annular groove 62, and so the control chamber 50 is disconnected from the pump work chamber 22. In this case, when the opening pressure in the pump work chamber 22 is reached, both injection valve members 28 and 128 open at least approximately simultaneously, and the total injection cross section of the fuel injection valve 12 is uncovered.

The variation in the position of the intermediate shaft 70 and thus in the outset stroke position of the pump piston 19 by the adjusting device 74 is effected as a function of such engine operating parameters as the rpm, load, and temperature, and optionally still other operating parameters. The adjusting device 74 is triggered by an electric control unit 76, by which the control valve 23 is also triggered. If, taking these operating parameters into account, only a slight fuel quantity is to be injected at the onset of the fuel injection, then by means of the control unit 76, the adjusting device 74 is triggered in such a way that the intermediate shaft 70 and thus the pump piston 18 are in the outset stroke position of the pump piston shown in the right half of FIG. 1, and at the onset of the fuel injection, only the first injection valve member 28 of the fuel injection valve 12 opens. If taking these operating parameters into account, only a greater fuel quantity is to be injected even at the outset of the fuel injection, then by means of the control unit 76, the adjusting device 74 is triggered in such a way that the intermediate shaft 70 and thus the pump piston 18 are in the outset stroke position of the pump piston shown in the left half of FIG. 1, and even at the outset of the fuel injection, both injection valve members 28 and 128 of the fuel injection valve 12 open. If the engine has a plurality of cylinders, then one high-pressure fuel pump 10 for each cylinder is provided, but for driving it only one camshaft 20 and one intermediate shaft 70 is provided. For varying the position of the intermediate shaft 70 and the outset stroke position of the pump pistons 18 of all the high-pressure fuel pumps 10, only a single adjusting device 74 is needed.

In FIG. 3, the fuel injection system is shown in a second exemplary embodiment, in which the fundamental layout is the same as in the first exemplary embodiment. In a departure from the first exemplary embodiment, however, in the second exemplary embodiment it is not the pump work chamber 22 that is used as a pressure source for controlling the pressure in the control chamber 50, but rather a fuel inlet, through which upon the intake stroke of the pump piston 18, fuel is delivered to the pump work chamber 22. Communicating with the fuel inlet is a fuel conduit 80 embodied in the pump body 14; this conduit discharges at the jacket of the cylinder bore 16 in which the pump piston 18 is guided. In a region offset circumferentially from the orifice of the fuel conduit 80, the conduit 63 that leads to the control chamber 50 discharges at the jacket of the cylinder bore 16. In the pump piston 18, a conduit 82 is embodied, which extends for instance radially to the longitudinal axis of the pump piston 18 and which discharges at the jacket of the of the pump piston 18. By means of the pump piston 18, as a function of its stroke position, the communication of the fuel conduit 80 with the conduit 63 to the control chamber 50 is controlled by the conduit 82 of the pump piston. In FIG. 3, the intermediate shaft 70 with the pump piston 18 is again shown in various positions. In an outset stroke position shown in the right half of the pump piston 18 in FIG. 3, the conduit 82 of the pump piston 18 is in coincidence with the orifice of the fuel conduit 80 and with the orifice of the conduit 63 leading to the control chamber 50, so that the control chamber 50 communicates with the fuel conduit 80. In the control chamber 50, the elevated pressure in the fuel conduit 80 is thus operative, so that in the fuel injection valve 12, the second injection valve member 128 remains in its closed position, and only the first injection valve member 28 opens. In the outset stroke position shown for the left half of the pump piston 18, the conduit 82 of the pump piston 18 is not in coincidence with the orifice of the fuel conduit 80 and the orifice of the conduit 63 leading to the control chamber 50, but instead is offset from them, so that the control chamber 50 is disconnected from the fuel conduit 80. Thus an elevated pressure is not operative in the control chamber 50, and in the fuel injection valve 12, both injection valve members 28 and 128 open.

The foregoing relates to preferred exemplary embodiments of the invention, it being understood that other variants and embodiments thereof are possible within the spirit and scope of the invention, the latter being defined by the appended claims.

We claim:

1. In a fuel injection system for an internal combustion engine, having one high-pressure fuel pump (10) and one fuel injection valve (12), communicating with it, for each cylinder of the engine, in which the high-pressure fuel pump (10) has a pump piston (18), driven in a reciprocating motion by the engine, which piston defines a pump work chamber (22) that communicates with a pressure chamber (40) of the fuel injection valve (12), and the fuel injection valve (12) has at least one first injection valve member (28), by which at least one first injection opening (32) is controlled and which is movable in an opening direction (29), counter to a closing force, by the pressure prevailing in the pressure chamber (40), and having a first electrically controlled control valve (23), by which a communication of the pump work chamber (22) with a relief chamber is controlled, the improvement wherein the fuel injection valve (12) has a second injection valve member (128), guided displaceably inside the hollow first injection valve member (28), by means of which second injection valve member at least one second injection opening (132) is controlled, and which second injection valve member is movable in an opening direction (29) counter to a closing force by the pressure prevailing in the pressure chamber; and wherein the second injection valve member (128) is acted upon at least indirectly by the pressure prevailing in a fuel-filled control chamber (50), which pressure is controllable as a function of operating parameters of the engine such that the second injection valve member (128), by means of the pressure prevailing in the control chamber (50), is blocked, independently of an opening motion of the first injection valve member (28), in a position that closes the at least one second injection opening (132).

2. The fuel injection system of claim 1, wherein the control chamber (50), for controlling the pressure prevailing in it, can be made to communicate with a pressure source (22; 80).

3. The fuel injection system of claim 2, wherein by means of the pump piston (18) of the high-pressure fuel pump (10), as a function of the stroke of this piston, a communication of the control chamber (50) with the pressure source (22; 80) is controlled.

4. The fuel injection system of claim 3, wherein by means of the pump piston (18), at a slight stroke, the communication of the control chamber (50) with the pressure source (22; 80) is opened, and at a greater stroke it is closed.

5. The fuel injection system of claim 3, further comprising an adjusting device (74) wherein in the drive mechanism between the engine and the pump piston (18) of the high-pressure fuel pump (10), by which adjusting device (74) an outset stroke position of the pump piston (18) is variable, based on which position the pump piston (18) executes its reciprocating motion.

6. The fuel injection system of claim 4, further comprising an adjusting device (74) wherein in the drive mechanism between the engine and the pump piston (18) of the high-pressure fuel pump (10), by which adjusting device (74) an outset stroke position of the pump piston (18) is variable, based on which position the pump piston (18) executes its reciprocating motion.

7. The fuel injection system of claim 5, wherein the drive mechanism comprises a camshaft (20) of the engine and an intermediate shaft (70), with a transmission element (71) actuated by the camshaft (20) and acting on the pump piston (18); and wherein the position of the intermediate shaft (70) is variable by means of the adjusting device (74) for varying the outset stroke position of the pump piston (18).

8. The fuel injection system of claim 6, wherein the drive mechanism comprises a camshaft (20) of the engine and an intermediate shaft (70), with a transmission element (71) actuated by the camshaft (20) and acting on the pump piston (18); and wherein the position of the intermediate shaft (70) is variable by means of the adjusting device (74) for varying the outset stroke position of the pump piston (18).

9. The fuel injection system of claim 2, wherein the pressure source is the pump work chamber (22) of the high-pressure fuel pump (10).

10. The fuel injection system of claim 3, wherein the pressure source is the pump work chamber (22) of the high-pressure fuel pump (10).

11. The fuel injection system of claim 4, wherein the pressure source is the pump work chamber (22) of the high-pressure fuel pump (10).

12. The fuel injection system of claim 5, wherein the pressure source is the pump work chamber (22) of the high-pressure fuel pump (10).

13. The fuel injection system of claim 6, wherein the pressure source is the pump work chamber (22) of the high-pressure fuel pump (10).

14. The fuel injection system of claim 7, wherein the pressure source is the pump work chamber (22) of the high-pressure fuel pump (10).

15. The fuel injection system of claim 9, further comprising a conduit (60) embodied in the pump piston (18), the conduit (60) discharging at one end into the pump work chamber (22) and at the other on the circumference of the pump piston (18), a cylindrical bore (16) supporting the pump piston (18) for reciprocal movement therein; and an annular groove (62) in the cylindrical bore (16) surrounding the pump piston (18) which groove communicates with the control chamber (50) via a conduit (63).

16. The fuel injection system of claim 2, wherein the pressure source comprises a fuel inlet (80), by way of which, upon the intake stroke of the pump piston (18), fuel is delivered into the pump work chamber (22).

17. The fuel injection system of claim 2, further comprising a conduit (60) embodied in the pump piston (18), the conduit (60), discharging at one end into the pump work chamber (22) and at the other on the circumference of the pump piston (18), a cylindrical bore (16) supporting the pump piston (18) for reciprocal movement therein; and an annular groove (62) in the cylindrical bore (16) surrounding the pump piston (18) which groove communicates with the control chamber (50) via a conduit (63).

18. The fuel injection system of claim 3, further comprising a conduit (60) embodied in the pump piston (18), the conduit (60), discharging at one end into the pump work chamber (22) and at the other on the circumference of the pump piston (18), a cylindrical bore (16) supporting the pump piston (18) for reciprocal movement therein; and an annular groove (62) in the cylindrical bore (16) surrounding the pump piston (18) which groove communicates with the control chamber (50) via a conduit (63).

19. The fuel injection system of claim 4, further comprising a conduit (60) embodied in the pump piston (18), the conduit (60), discharging at one end into the pump work chamber (22) and at the other on the circumference of the pump piston (18), a cylindrical bore (16) supporting the pump piston (18) for reciprocal movement therein; and an annular groove (62) in the cylindrical bore (16) surrounding the pump piston (18) which groove communicates with the control chamber (50) via a conduit (63).

20. The fuel injection system of claim 5, further comprising a conduit (60) embodied in the pump piston (18), the conduit (60), discharging at one end into the pump work chamber (22) and at the other on the circumference of the pump piston (18), a cylindrical bore (16) supporting the pump piston (18) for reciprocal movement therein; and an annular groove (62) in the cylindrical bore (16) surrounding the pump piston (18) which groove communicates with the control chamber (50) via a conduit (63).

21. The fuel injection system of claim 6, further comprising a conduit (60) embodied in the pump piston (18), the conduit (60), discharging at one end into the pump work chamber (22) and at the other on the circumference of the pump piston (18), a cylindrical bore (16) supporting the pump piston (18) for reciprocal movement therein; and an annular groove (62) in the cylindrical bore (16) surrounding the pump piston (18) which groove communicates with the control chamber (50) via a conduit (63).

* * * * *